United States Patent [19]

Halls et al.

[11] Patent Number: 4,740,257

[45] Date of Patent: Apr. 26, 1988

[54] CEILING TILE COVERING SYSTEM

[75] Inventors: Kenneth F. Halls, Arvada; Donald W. Harrison, Golden, both of Colo.

[73] Assignee: Acoustic Industries, Inc., Arvada, Colo.

[21] Appl. No.: 50,893

[22] Filed: May 15, 1987

Related U.S. Application Data

[63] Continuation-in-part of Ser. No. 707,908, Mar. 4, 1985, Pat. No. 4,666,540.

[51] Int. Cl.[4] ..... B32B 31/12; B32B 7/08; B32B 35/00

[52] U.S. Cl. ..... 156/92; 29/275; 29/402.09; 29/432; 29/798; 30/367; 52/4; 52/746; 156/71; 156/94; 156/574; 156/575; 156/579; 428/63; 428/99

[58] Field of Search ..... 29/275, 402.09, 402.14, 29/432, 798; 30/367; 52/4, 746; 156/71, 92, 94, 252, 510, 574, 575, 579; 181/290, 294, 296; 428/63, 99, 100

[56] References Cited

U.S. PATENT DOCUMENTS

| | | | |
|---|---|---|---|
| 1,505,908 | 8/1924 | MacKinnon | 427/196 |
| 1,863,842 | 6/1932 | Grigsby . | |
| 1,946,690 | 2/1934 | Haines . | |
| 2,038,920 | 4/1936 | Bishop . | |
| 2,512,469 | 6/1950 | Poss | 156/92 |
| 2,531,128 | 11/1950 | Hobbs | 156/71 X |
| 2,872,804 | 2/1959 | Baldanza . | |
| 3,092,203 | 6/1963 | Slayter et al. | 156/254 X |
| 3,265,547 | 8/1966 | Selbe | 156/85 |
| 3,632,465 | 1/1972 | Hardingham | 156/92 X |
| 4,441,295 | 4/1974 | Kelly | 52/746 X |
| 4,528,051 | 7/1985 | Heinze et al. | 156/92 |
| 4,581,870 | 4/1986 | Winkowski | 428/63 X |
| 4,624,721 | 11/1986 | Sadler et al. | 156/92 |

*Primary Examiner*—Robert A. Dawson

*Attorney, Agent, or Firm*—Fields, Lewis, Pittenger & Rost

[57] ABSTRACT

Disclosed is a system for covering installed ceiling tiles without removal of the tiles from the ceiling. The system includes a novel facing for covering an installed ceiling tile, a method of applying the facing to the face of an installed tile and apparatus for carrying out the method. The novel facing includes a panel of at least semi-rigid material having a decorative surface, an underside surface and a flexible border which extends at an angle from and about the periphery of the decorative surface. The panel's underside surface is prefit to cover the face of an installed ceiling tile and is provided with selectively located pins which project from the underside surface of the facing. The disclosed method includes providing the aforementioned decorative facing and marking the face of the tile to provide selectively located marks on the face of the tile which are capable of aligning with the facing's selectively located pins to center the facing on the tile. After marking the tile, the decorative facing is positioned up against the tile so that its pins are in contact with and aligned with the alignment marks provided on the face of the tile. The facing is then struck by an operator with his fist or a mallet to drive the aligned pins into the tile to secure the facing to the tile. A multi-punch adaptor for attachment to the punch shaft of a pneumatic impact gun is also disclosed. The adaptor enables a plurality of selectively located marks to be make simultaneously on the face of an installed ceiling tile.

17 Claims, 3 Drawing Sheets

CEILING TILE COVERING SYSTEM

CROSS REFERENCE TO RELATED APPLICATIONS

This application is a continuation-in-part of copending application U.S. Ser. No. 707,908 entitled "Method for Refurbishing Building Panels" filed on Mar. 4, 1985 and now U.S. Pat. No. 4,666,540.

TECHNICAL FIELD

This invention relates generally to a system for refinishing installed ceiling tiles and more particularly to a low cost, on-site system for covering ceiling tiles without having to remove them from the ceiling. Due to its low cost, the present invention is particularly amenable to refinishing large expanses of ceiling tiles.

BACKGROUND ART

Ceiling tiles have been used extensively for years in home, office and industrial environments. The tiles are typically very light due to their high porosity. Unfortunately their lightness makes them particularly vulnerable to damage, wear and discoloration which is typically caused by water damage or by workman attempting to remove the tiles. Until the invention disclosed in said U.S. Pat. No. 4,666,540, it was standard practice to replace the damaged or discolored tiles with new tiles. It was difficult to wash the tiles and prior to our invention it was extremely difficult to repair them without leaving noticeable evidence of the repair. Moreover, simply replacing a few of the old tiles on a ceiling with new tiles was not generally acceptable from an aesthetic standpoint since new tiles rarely match old tiles. One replacing such tiles often discovers that the pattern or style of the old tiles is no longer available or if it is available, one often finds that the old tiles have faded too much to match the new tiles. Accordingly, where appearance is important, it is often necessary to replace the entire ceiling, not just those tiles which are damaged or discolored. The replacement of such, quite obviously, can be an expensive undertaking, particularly when large areas are involved.

As previously mentioned, the invention disclosed in co-pending application U.S. Ser. No. 707,908 addresses the aforementioned problems by providing an on-site method of refinishing worn or discolored building panels. In the method, panels are first removed from their installed location. The panel is then sprayed with an adhesive and covered with a thin sheet of decorative material. Pressure is then applied to the panel, covering, and adhesive, resulting in a neat, secure bond. The refinished panel is then installed in its original location with the new covering exposed.

Systems providing tiled surfaces for covering walls are also noted in the art. U.S. Pat. No. 1,863,842 to Grigsby discloses a structure for covering a wall with tiles. The structure includes a sheet for attachment to a wall and a plurality of tiles, each of which is provided with protrusions extending from the tile which fit into preformed holes provided in the sheet to secure the tile to the sheet.

U.S. Pat. No. 1,946,690 to Haines discloses another structure for covering a wall with tiles. The structure includes a metallic sheet for attachment to a wall and a plurality of tiles, each of which is provided with marginal flanges which fit with preformed lugs projecting from the sheet to align tiles on the sheet. The tiles are set on the sheet after a layer of mortar has been applied to the sheet.

U.S. Pat. No. 2,038,920 to Bishop discloses a covering a system for covering a wall, floor or ceiling with tiles. The system includes a fibrous backing panel and a plurality of tile units for covering the panel. Nailing spurs are provided on each tile unit for penetrating and securing the tile unit to the backing. Spacing lugs are also provided on each tile to space the tiles from one another. After securing the tiles to the backing, a plastic composition is applied to point the tiles and fill the spaces between the tiles and the backing.

U.S. Pat. No. 2,872,804 to Baldanza discloses a mortarless tile construction system. The system includes a backing sheet and a plurality of tiles having sides which interlock with adjacent tiles. The tiles are also provided with projections which extend through preformed holes provided in the backing sheet to secure the tiles thereto.

Methods of covering panels prior to installation are also noted in the art. An apparatus and method for adhering a plastic covering to an acoustical panel is disclosed in U.S. Pat. No. 3,092,203 to Slater, et al. U.S. Pat. No. 3,265,547 to Selby discloses a method of applying, by heat, a plastic film having decorative qualities to wall panels, form board, roof planks, acoustical and decorative tile, plywood panels and ceiling board. A method of applying adhesive to a wall panel and the like prior to installation is disclosed in U.S. Pat. Nos. 2,531,128 to Hobbs, and in 1,505,908 to MacKinnon.

While the foregoing patents disclose useful tile construction systems and systems for covering building panels with sheets, there is still a need for a system capable of covering installed ceiling tiles which is low cost, simple to use, fast and capable of covering the tiles without having to remove them from the ceiling.

DISCLOSURE OF THE INVENTION

The present invention addresses the aforementioned concerns by providing a system for covering installed ceiling tiles which does not require removal of the tiles from the ceiling. The system includes a novel facing for covering an installed ceiling tile, a method of applying the facing to the face of an installed ceiling tile and apparatus for carrying out the method.

The novel facing includes a panel of at least semi-rigid material having a decorative surface, an underside surface and a flexible border extending at an angle from and about the periphery of the decorative surface. The panel's underside surface is prefit to cover the face of an installed ceiling tile and is provided with selectively located pins projecting upwardly from the underside surface for securing the facing to an installed ceiling tile. The border is flexible or resilient so that when the facing is installed to cover the face of a ceiling tile, the flexible border will bend and abut against the flexible border of an adjacent installed facing. As such, the abutting borders of the adjacent facings will cover the joint which exists between the tiles underlying the adjacent facings.

The method of the present invention for covering an installed ceiling tile includes the step of providing a decorative facing which is prefit to cover the face of a ceiling tile and which is provided with selectively located pins for securing the facing to the tile. The face of the tile is then marked to provide selectively located alignment marks thereon which are capable of aligning with the selectively located pins on the facing so as to enable the facing to be centered or aligned on the tile. After marking the face of the tile, the facing is positioned up against the face of the tile so that its pins are in contact with and aligned with the alignment marks provided on the face of the tile. The facing is then contacted preferably by striking the facing with one's fist or a mallet to drive the aligned pins into the tile to secure the facing thereto.

An apparatus for providing the selectively located marks simultaneously on the face of an installed ceiling tile includes a multi-punch adaptor for attachment to the punch shaft of a pneumatic impact gun. The adaptor includes a cruciform frame housing having four ends with a cavity provided in each end. A punch is disposed in each cavity along with a coil spring which is located about each punch and attached thereto. The adaptor also includes a cross-shaped punching force transmitting means which is disposed in the cruciform frame housing. The transmitting means has four arms, each of which has an outer end attached to one of the punches. In addition, the transmitting means includes an attachment means at its center for securing the transmitting means to the punch shaft of a pneumatic impact gun. When the impact gun is activated, the transmitting means transmits the punching force delivered via the punch shaft of the impact gun to each of the four punches which are propelled partially out of their respective cavities to a punching position. The simultaneous propulsion of the four punches enables four marks to be made simultaneously in the face of a ceiling tile when the adaptor is located against the tile and the impact gun is activated. The coil springs serve to immediately return the punches and the punching force transmitting means to a resting state after the punching force has been delivered by the impact gun.

An apparatus for supporting an impact device to which a multi-punch adaptor of the present invention is attached is also provided. The apparatus includes a tripod base having an extension mast and a counterweighted pivoting arm. The pivoting arm is pivotally attached at its midsection to an upper end of the mast. The counterweight is attached to the arm's lower end and the impact device is attached to the arm's upper end. The support apparatus enables an operator to make selectively located marks on an installed ceiling while the operator is standing on the floor below the ceiling.

Additional advantages of the invention will be understood from the description which follows, taken in conjunction with the accompanying drawings.

BEST MODE FOR CARRYING OUT THE INVENTION

Figure 1:
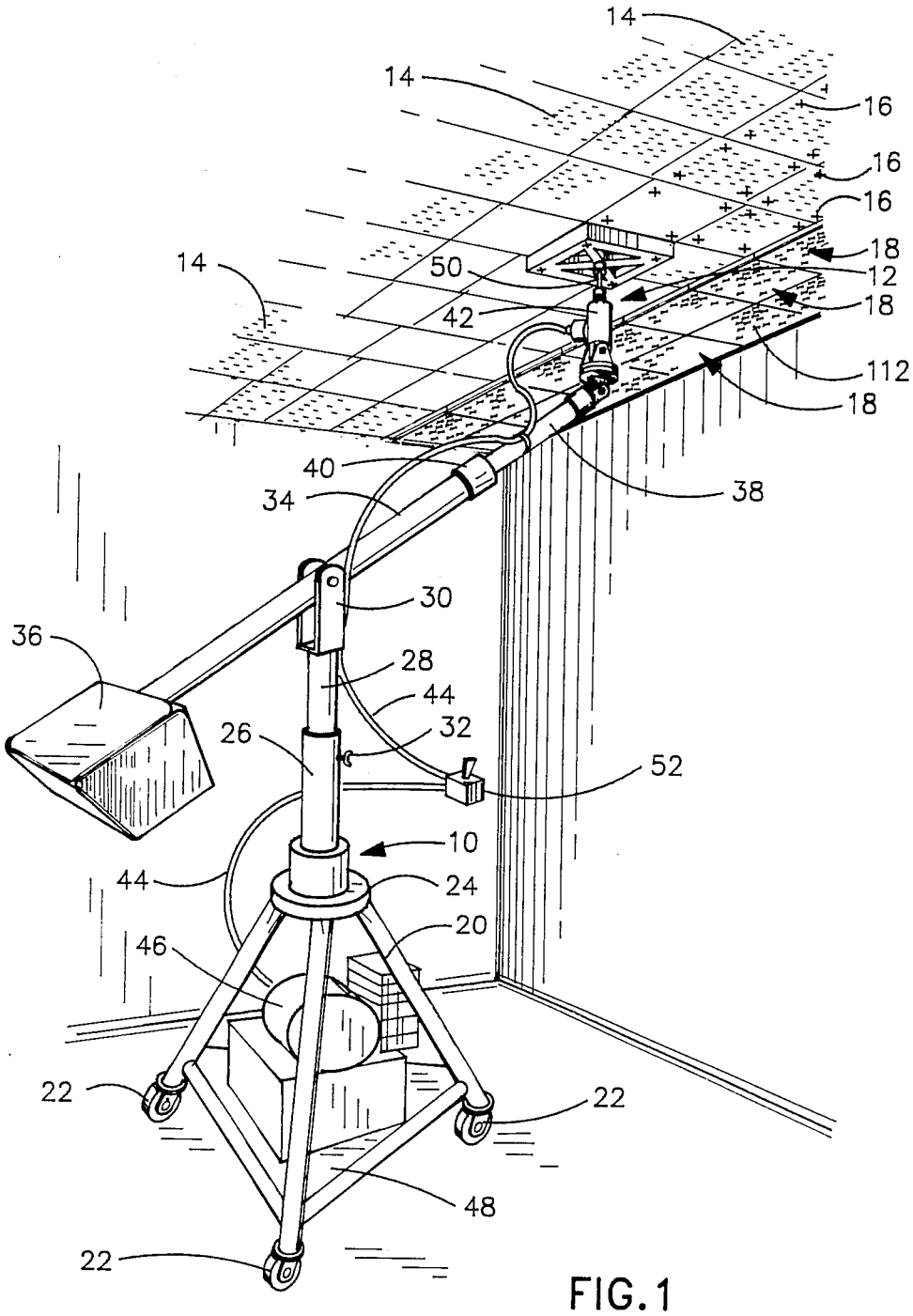
FIG. 1 is a perspective view of an embodiment of the present invention for marking the face of an installed ceiling tile to provide it with selectively located alignment marks.

Referring now to the drawings, FIG. 1 generally illustrates a tripod support apparatus 10 supporting an impact device 12 of the present invention. As shown, impact device 12 is in the process of scoring one of a plurality of old previously installed ceiling tiles 14. FIG. 1 also illustrates a number of tiles 14 adjacent impact device 12 which have already been scored by impact device 12 to provide each tile with four score marks 16, one at each corner of the tile. In addition, FIG. 1 illustrates two rows of new decorative facings 18 of the present invention covering two rows of old ceiling tiles 14.

Tripod support apparatus 10 has three legs 20, each of which has a swivel wheel 22 attached at its lower end. Legs 20 converge at their upper ends into a mast base support 24 which supports a telescoping extension mast having an outer lower tube 26, an inner upper telescoping tube 28 and a pivotal bracket 30. A set screw 32 can be untightened to permit the height of the telescoping tube to be raised or lowered as desired. Bracket 30 is pivotally attached to a pivoting arm 34 which has a counterweight 36 attached to its lower end. Pivoting arm 34 has a telescoping upper extension 38 at its upper end which can be telescopingly moved in and out of arm 34 when a tightening collar 40 is untightened. Both set screw 32 and tightening collar 40 prevent relative movement of their respective telescoping components when they are tightened.

Upper extension 38 is pivotally attached at its upper end to an end of a pneumatic impact gun 42 of impact device 12 of the present invention. Impact gun 42 is connected by a hose 44 to an air compressor 46 located on a bottom shelf 48 of the tripod support. Impact gun 42 has a punch shaft 50 which is propelled or thrust outwardly a preselected distance when the gun is activated. The impact gun is activated in a conventional manner when a switch 52 is switched to its on position by an operator which permits compressed air to enter the gun.

Figure 3:
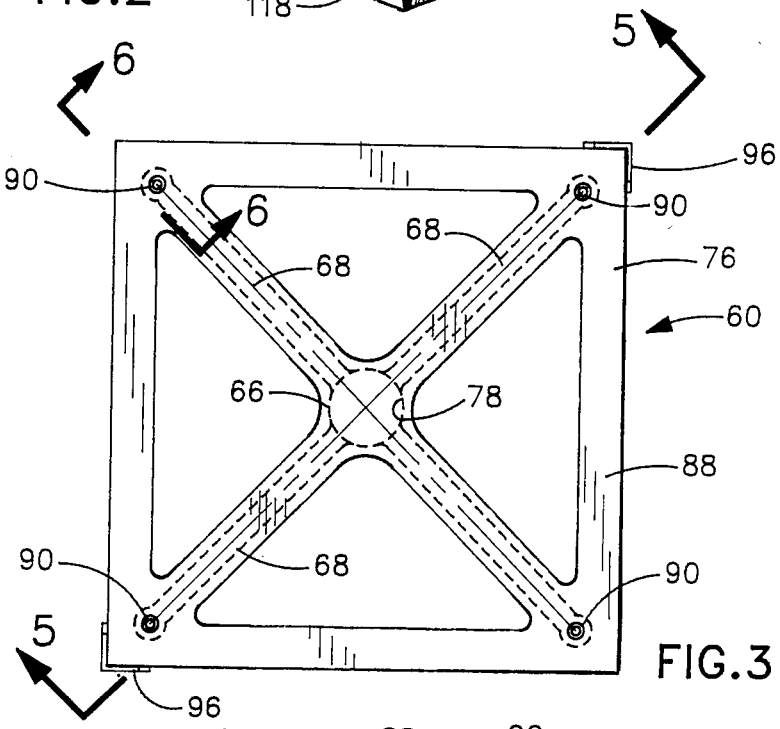
FIG. 3 is a top plan view of a multi-punch adaptor of the present invention for attachment to a pneumatic impact gun.
Figure 4:
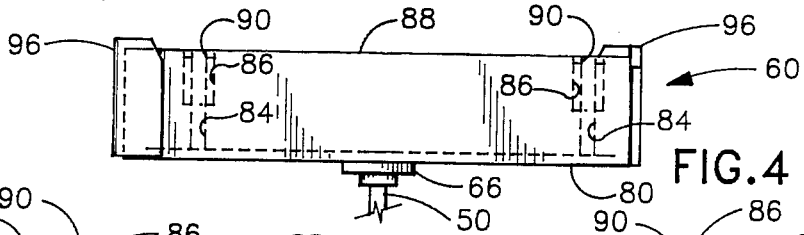
FIG. 4 is a side view of the adaptor illustrated in FIG. 3.

Impact device 12 also includes a multi-punch adaptor 60 of the present invention which is illustrated in FIGS. 1 and 3 through 7. Adaptor 60 has a punching force transmitting means 62 which is provided with a bore 64 at its hub 66 which receives the end of punching shaft 52 of the impact gun. Shaft 52 is tightly secured to the bore by a conventional attachment means (not shown). Transmitting means 62 is also provided with four force transmitting arms 68, each of which extends outwardly from hub 66 and each of which is spaced equally from the other. As such, transmitting means 62 has a cross-shaped appearance as is illustrated in FIG. 3. The outer end of each arm 68 is provided with a bore 70 which receives the lower end of a shaft 72 of a star shaped punch 74. The punch shafts are preferably tightly secured to their respective bores 70 with a set screw (not shown) which also permits the punch to be removed when it is necessary to replace or sharpen the punch.

Figure 6:
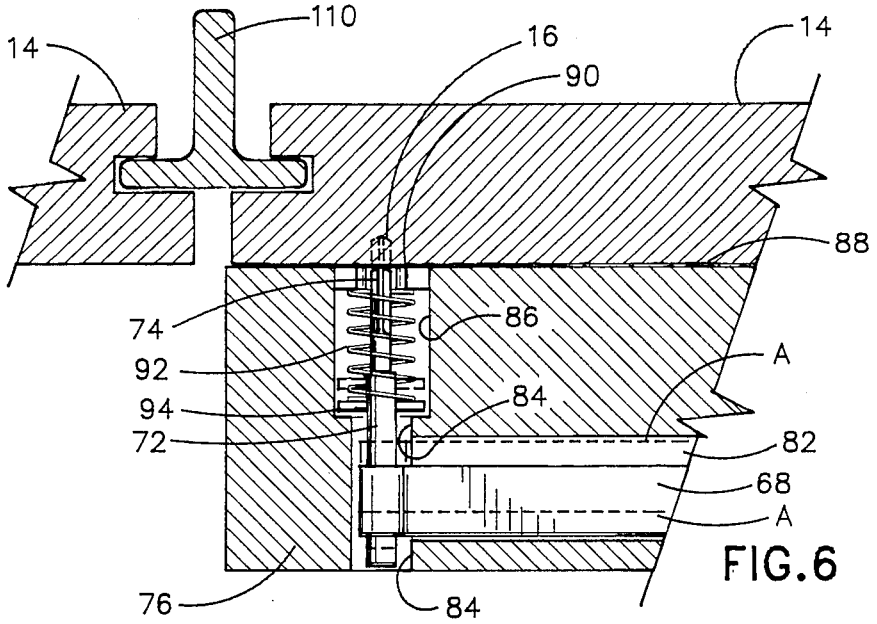
FIG. 6 is a partial enlarged, cross-sectional view taken along the lines 6—6 of FIG. 3.
Figure 7:
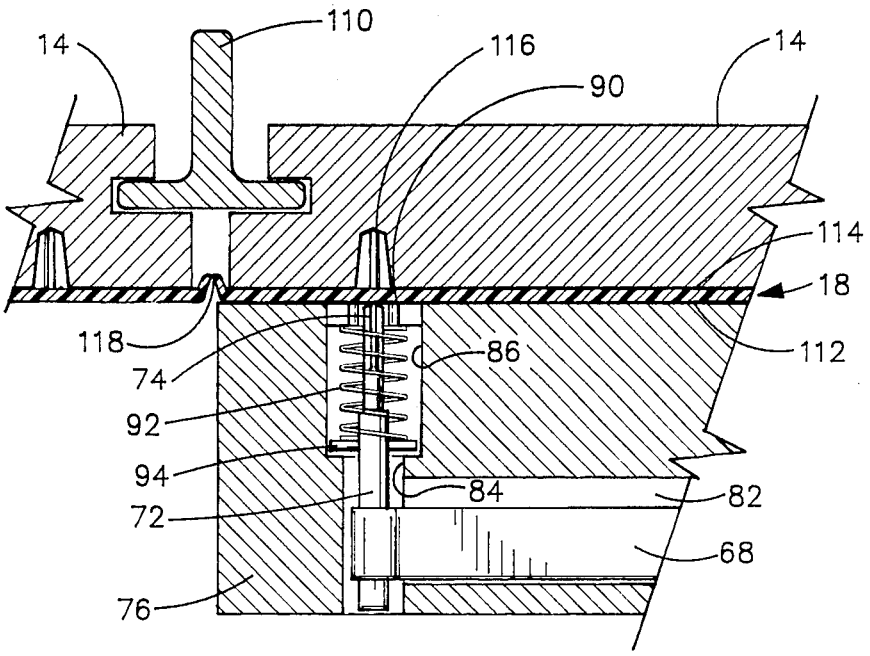
FIG. 7 is a partial cross-sectional view similar to FIG. 6 but showing the multi-punch adaptor being used to strike the decorative facing of the present invention to secure it to an installed ceiling tile.

Punching force transmitting means 62 and punches 74 are disposed within a cruciform frame housing 76. The transmitting means' hub 66 is disposed in and extends from a complementary-shaped bore 78 provided in the housing's bottom surface 80. Each transmitting arm 68 is disposed in a housing defining corridor 82 having a lower cylindrical cavity 84 at its outer end. Each punch 74 is axially disposed in a housing defining upper cylindrical cavity 86 and the lower cavity 84. As best illustrated in FIGS. 6 and 7, cavity 84 opens into upper cavity 86, and is axially aligned therewith but it has a smaller diameter than cavity 86. The upper end of each upper cavity 86 opens through an axially aligned opening 90 (having a smaller diameter than cavity 86) onto an upper planar surface 88 of the cruciform housing.

Figure 5:
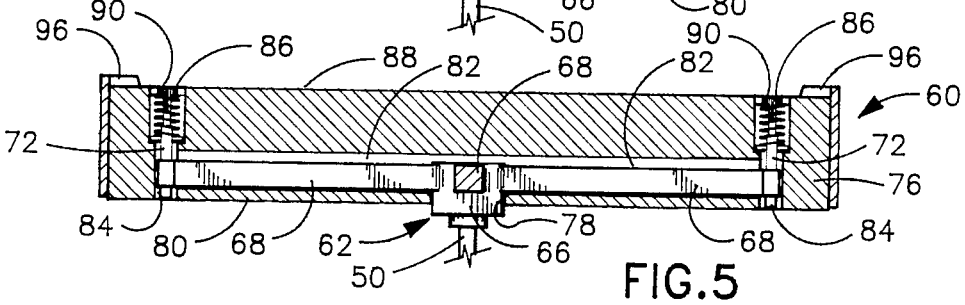
FIG. 5 is a cross-sectional view taken along the lines 5—5 of FIG. 3.

FIGS. 5, 6 and 7 also illustrate the provision of a coil spring 92 disposed within each upper cavity 86 and about each punch 74. Each spring 92 is attached, preferably welded, at its lower end to a flange 94 which is welded to the upper portion of each punch's shaft 72. Springs 92 serve to return the punches and the transmitting means to a resting state after a punching force has been delivered by activation of the impact gun. The operation of the adaptor and impact gun will be discussed in more detail below.

Returning to FIGS. 3 and 6, it can be seen that cruciform frame housing 76 is also provided with a pair of peripheral lips 96 which as best illustrated in FIG. 3 are located at diagonally opposite ends or corners of the housing and extend slightly above upper surface 88 of the housing. Lips 96 are configured to engage opposite corners of an installed ceiling tile to align the adaptor with the tile.

Figure 2:
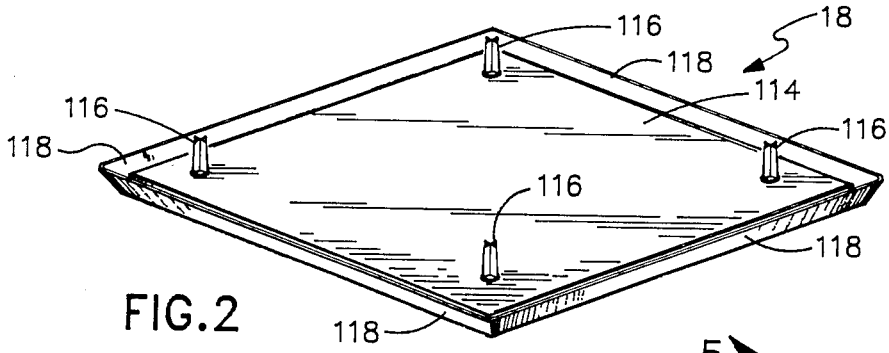
FIG. 2 is a perspective view of a decorative facing provided by the present invention.

FIG. 2 is a perspective view of a decorative facing 18 of the present invention for a covering ceiling tile 14 having already been installed on a ceiling on runners such as runner 110 illustrated in FIGS. 6 and 7.

Facing 18 is preferably made of semi-rigid or rigid material such as ABS plastic by an injection process. ABS plastic is an acrylonitrile-butadiene sytrene terpolymer. Facing 18 has a decorative surface 112 and an underside surface 114 which is prefit to cover the face of a ceiling tile precisely. The underside surface also has four selectively located pins 116 which project upwardly therefrom. The pins are selectively located on the facing's underside so that they will align with score marks 16 provided on the face of an installed ceiling tile to properly or squarely align the facing with the tile. The pins also serve to secure facing 18 to the ceiling tile when they are driven into the tile.

Facing 18 also has a flexible angled border 118 which extends upwardly at an angle from the sides or periphery of the facing's decorative surface. The border is preferably made from the same material as the facing and is integral therewith. However, it should have a thickness which permits it to be flexible so that it is capable of bending and abutting up against the flexible border of an adjacent facing. As such, the abutting borders of two adjacent facings will cover the recessed joint exposing runner 110 which lies between the adjacent pair of installed ceiling tiles. Since the borders are flexible they should also bend together evenly, thereby masking any possible misalignment of the underlying ceiling tiles.

To install a facing 18 on the face of an installed ceiling tile 14, an operator first marks scores or indents the ceiling tile to provide the tile with the selectively located alignment marks 16 illustrated in FIG. 1. This is preferably done by locating the peripheral lips 96 of cruciform frame housing 76 about opposite corners of the ceiling tile and by positioning upper surface 88 of the housing against the face of the ceiling tile. Impact device 12 is then activated by turning switch 52 on which propels punch shaft 50 of the impact gun 42 upwardly a predetermined distance towards the face of the ceiling tile. Punching force transmitting means 62 attached to punch shaft 50 receives the force delivered by the impact gun which propels it upwardly within corridors 82 of the housing to the position indicated in FIG. 6 by dotted line A. Punches 74 attached to arms 68 of the transmitting means are similarly propelled upwardly to the point where they project a preselected distance above surface 88 of the housing and, as such, score ceiling tile 14 to provide score marks 16, one of which is illustrated in FIG. 6.

After scoring ceiling tile 14, switch 52 is turned off. This enables the springs 92 (which at this point are compressed) to recoil which returns the punches, transmitting mean and punch shaft 50 to their resting positions which are illustrated in solid lines in FIG. 6. The impact device is then lowered away from the ceiling tile.

A facing 18 with its underside surface 114 facing towards the tile is then positioned up against the tile so that its pins 116 are in contact with and aligned with alignment score marks 16 having been scored in the face of the ceiling tile. This positioning of the facing can be done manually by an installer.

The decorative surface of the facing is then struck by the operator with either his fist or a mallet which drives the facing's pins through the score marks (which are of a smaller dimension than the pins) into the ceiling tile to secure the facing to the tile. If desired, an adhesive may also be spread on a portion of the facing's underside prior to installing the facing. The use of an adhesive will enhance the facing's securement to the tile which may be desirable in certain applications.

The facing may also be positioned against the tile by placing the facing on the housing's upper surface 88 which is then raised to the ceiling tile and positioned so that the facing pins are in contact with and aligned with the score marks, as previously mentioned. Pins 116 are then driven into the ceiling tile to secure the facing to the tile by an operator who simply pushes upwardly on mast 34 which causes upper surface 88 of the housing to move upwardly against the face of the ceiling tile which, in turn, drives the facing's pins into the ceiling tile, as is illustrated in FIG. 7.

Based on the foregoing description a number of significant advantages for the present invention are readily apparent. A method and apparatus are provided for covering worn, faded or discolored ceiling tiles at a fraction of the cost of replacing the tiles with new ones. The method can be performed rapidly without removing the old tiles thereby minimizing disruption of the work place. In addition, the present invention provides a novel facing for covering a ceiling tile which is as durable or even more durable than the original tile, and in fact, may even be washed.

The invention has been described in detail with particular references to a preferred embodiment thereof, but it will be understood that variations and modifications can be effected within the spirit and scope of the invention.

What is claimed is:

1. A method of covering an installed ceiling tile comprising the steps of:

providing a decorative facing for covering the installed ceiling tile, the facing being prefit to cover the face of the tile and being provided with selectively located pins on its underside for securing the facing to the tile, the location of the pins on the facing's underside being selected to enable the pins to be aligned with selectively located alignment marks provided on the face of the tile;

marking the face of the tile to provide the selectively located alignment marks, the marks enabling the facing to be centered or aligned on the tile;

positioning the facing up against the tile so that its pins are aligned with the alignment marks provided on the face of the tile;

driving the aligned pins into the tile to secure the facing thereto.

2. A method, as claimed in claim 1, wherein:

the step of marking includes scoring the face of the tile to provide the selectively located marks.

3. A method, as claimed in claim 2, wherein:

the scored marks are holes having a size which is smaller than the pins but large enough to enable the tips of the pins to be inserted into the holes so that the pins are capable of being aligned with the holes by locating the facing with its pins facing upwardly against the tile and by sliding the facing along the face of the tile until the tips of the pins are inserted into their respective holes.

4. A method, as claimed in claim 1, wherein:

said step of marking includes indenting the face of the tile to provide the selectively located marks.

5. A method, as claimed in claim 1, wherein:

the marks are selectively located adjacent the corners of the tile.

6. A method, as claimed in claim 1, wherein:

the marks are made simultaneously on the face of the tile.

7. A method, as claimed in claim 6, wherein:

the step of driving the pins into the tile includes striking the facing with an impact device.

8. A method, as claimed in claim 1, wherein:

said step of driving the pins includes striking the facing to drive the pins into the tile.

9. A method, as claimed in claim 8, wherein:

the striking of the facing is done by an installer with his or her fist.

10. A method, as claimed in claim 8, wherein:

the striking is done by an operator with a mallet or hammer.

11. A method, as claimed in claim 1, further comprising the step of:

applying an adhesive to the underside of the facing to enhance securement of the facing to the tile.

12. A multi-punch adaptor for attachment to the punch shaft of a pneumatic impact gun, said adaptor comprising:

a cruciform frame housing having four ends with a cavity provided in each end;

a punch disposed in each cavity;

a coil spring disposed in each cavity and located about and being attached to each punch;

cross-shaped punching force transmitting means disposed in said cruciform frame housing, said means having four arms, each of which has an outer end attached to one of said punches, said transmitting means being further provided with attachment means at its center for securing the transmitting means to the punch shaft of the pneumatic impact gun, said transmitting means being capable of transmitting a punching force delivered by the punch shaft of the impact gun to each of the four punches, said punches propelling partially out of their respective cavities simultaneously to a punching position upon receiving said punching force, which thereby enables marks to be made simultaneously in the face of a tile when the adaptor is located against the tile and the impact gun is activated, said coil springs serving to immediately return the punches and the punching force transmitting means to a resting state after the punching force has been delivered by activation of the impact gun.

13. A multi-punch adaptor, as claimed in claim 12, further comprising:

alignment means located on the cruciform frame housing for aligning the adaptor with an installed ceiling tile to selectively locate the marks on the face of the tile.

14. A multi-punch adaptor, as claimed in claim 13, wherein:

the alignment means includes peripheral lips located at two opposing ends of the cruciform frame housing, said lips being configured to engage opposite corners of an installed ceiling tile to align the adaptor with the tile.

15. A multi-punch adaptor, as claimed in claim 12, wherein the punches are star shaped.

16. A multi-punch adaptor, as claimed in claim 12, further comprising a support apparatus including:

a tripod base having an extension mast; and a pivoting arm having opposite ends and being pivotally attached intermediate said ends to an upper end of the mast;

a counterweight attached to one end of the arm; and said impact gun being attached to the other end of the arm, said support apparatus enabling an operator to make selectively located marks on an installed ceiling tile while an operator is standing on the floor below the ceiling.

17. A decorative facing for covering an installed ceiling tile, said facing comprising:

a panel of at least semi-rigid material having:

a decorative surface;

an underside surface which is prefit to cover the face of a ceiling tile and which is provided with selectively located pins projecting upwardly from the underside surface for securing the facing to the installed ceiling tile; and a flexible border extending at an angle from and about the periphery of the decorative surface, said border being flexible so that when its facing is installed to cover a ceiling tile, the border bends and abuts up against the flexible border of an adjacent installed facing, said abutting borders serving to cover the joint existing between the tiles which underlie the adjacent facings.

* * * * *